US008988305B1

(12) United States Patent
Eray

(10) Patent No.: US 8,988,305 B1
(45) Date of Patent: Mar. 24, 2015

(54) PORTABLE WIRELESS PHONE DEVICE

(71) Applicant: Eray Innovation, Saint Gregoire (FR)

(72) Inventor: Yves Eray, Zaragoza (ES)

( * ) Notice: Subject to any disclaimer, the term of this patent is extended or adjusted under 35 U.S.C. 154(b) by 0 days.

(21) Appl. No.: 14/060,521

(22) Filed: Oct. 22, 2013

(51) Int. Cl.
*H01Q 7/00* (2006.01)
*H01Q 1/24* (2006.01)

(52) U.S. Cl.
CPC ..... *H01Q 7/00* (2013.01)
USPC ..... 343/866; 343/702

(58) Field of Classification Search
USPC ..... 343/702, 741, 866, 895
See application file for complete search history.

(56) References Cited

U.S. PATENT DOCUMENTS

| | | | | |
|---|---|---|---|---|
| 7,333,062 | B2 * | 2/2008 | Leizerovich et al. | 343/702 |
| 8,035,565 | B2 * | 10/2011 | Gamand | 343/702 |
| 2010/0063893 | A1 * | 3/2010 | Townsend | 705/26 |
| 2011/0065476 | A1 * | 3/2011 | Hsiao et al. | 455/558 |
| 2014/0203981 | A1 * | 7/2014 | Nakano et al. | 343/749 |
| 2014/0203992 | A1 * | 7/2014 | Nakano et al. | 343/867 |

* cited by examiner

*Primary Examiner* — Tan Ho

(57) ABSTRACT

The invention concerns a portable wireless phone device, having a first antenna for phone communication, an upper display attached to an external housing assembly, an inner metallic board situated between the upper display module and the external housing assembly, a second NFC antenna and an electrical circuit for controlling the upper display module, the first antenna and the second NFC antenna. The second NFC antenna comprises a NFC loop antenna having at least one turn.

10 Claims, 8 Drawing Sheets

PORTABLE WIRELESS PHONE DEVICE

FIELD OF THE INVENTION

The invention concerns a portable wireless phone device provided with at least one NFC antenna.

BACKGROUND OF THE INVENTION

NFC antennas are known to provide RFID capabilities, for example for reader and/or transponder applications.

Document WO 2009/085777 describes an apparatus for providing radio frequency identification (RFID) and touch sensing capability, comprising: a touch sensor panel, the touch sensor panel including one or more substrates and a plurality of drive lines and a plurality of sense lines, the plurality of drive lines and the plurality of sense lines formed on one or more of the substrates; and an RFID circuit, the RFID circuit including an antenna and a control circuit coupled to the antenna, the antenna formed on a same side of the substrate as either the plurality of drive lines or the plurality of sense lines.

One of the problems of the portable wireless phone device provided with this RFID circuit is the low current flowing in the RFID antenna.

It follows that the magnetic field radiated by the antenna is too small.

This does not enable a good application of the phone device as a RFID reader and/or RFID transponder.

The invention aims to obviate the drawbacks of the prior art and to have a better reception and emission of the NFC antenna of the portable wireless phone device.

SUMMARY OF THE INVENTION

According to an aspect of the invention, there is provided a portable wireless phone device, comprising a first antenna for phone communication, an upper display module having a first upper face, a first lower face and first side faces connecting the first upper face to the first lower face, an inner metallic board situated between the first lower face and a second lower face of an external housing assembly having second side faces connected to the second lower face, each first side face facing one of the second side faces, the external housing assembly enclosing the inner metallic board, the first antenna, a second NFC antenna and an electrical circuit for controlling the upper display module, the first antenna and the second NFC antenna, wherein the second NFC antenna comprises a NFC loop antenna having at least one turn, wherein the at least one turn comprises at least one first part situated at a distance from the inner metallic board and between at least one determined of the first side faces and at least one determined of the second side faces, facing each other, at least one second part situated under the first lower face.

According to an embodiment of the invention, the second part is situated between the first lower face and the inner metallic board.

According to an embodiment of the invention, the second part comprises a first subpart situated between the first lower face and the inner metallic board.

According to an embodiment of the invention, the second part comprises a second subpart situated between the inner metallic board and the second lower face.

According to an embodiment of the invention, the inner metallic board comprises at least one hole, wherein the second part gets through the hole.

According to an embodiment of the invention, the first part comprises at least one rectilinear segment.

According to an embodiment of the invention, the first part extends under a second upper face of the external housing assembly facing the second lower face. According to an embodiment of the invention, an upper transparent wall is provided on the first upper face of the upper display module, the upper transparent wall has a third upper face, a third lower face and third side faces connecting the third upper face to the third lower face, each third side face facing one of the second side faces, the third lower face is against the first upper face, the first part of the at least one turn is situated between at least one determined of the third side faces of the upper transparent wall and at least one determined of the second side face.

According to an embodiment of the invention, the second part is entirely situated between the inner metallic board and the second lower face of the external housing assembly, the inner metallic board comprises at least one hole, the at least one turn comprises at least one third part connecting the first part to the second part, the third part gets through the hole.

According to an embodiment of the invention, the second part comprises at least one rectilinear segment.

DETAILED DESCRIPTION OF THE INVENTION

Figure 1:
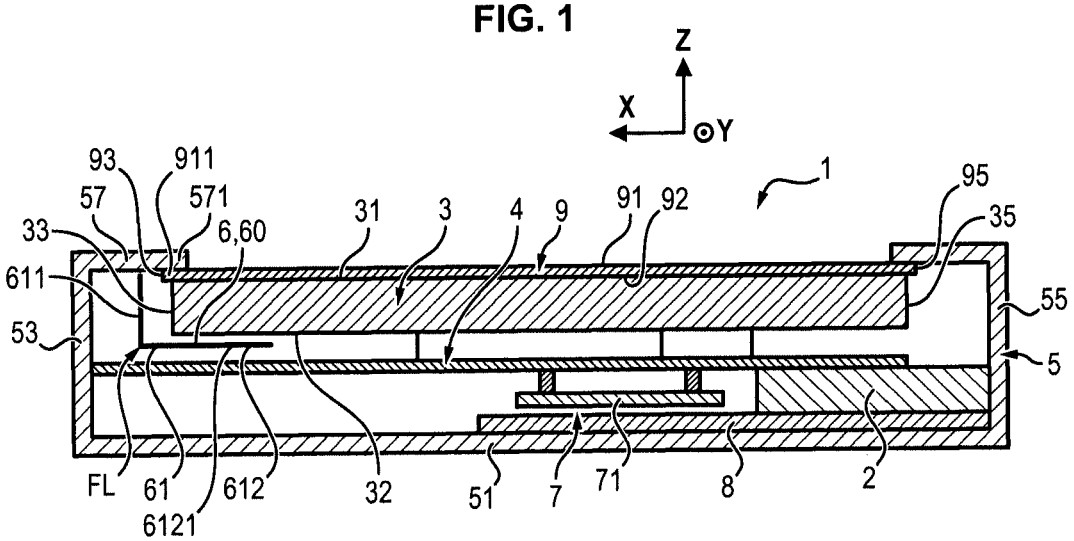
FIG. 1 is a schematic cross section side view of a portable wireless phone device according to a first embodiment of the invention.
Figure 2:
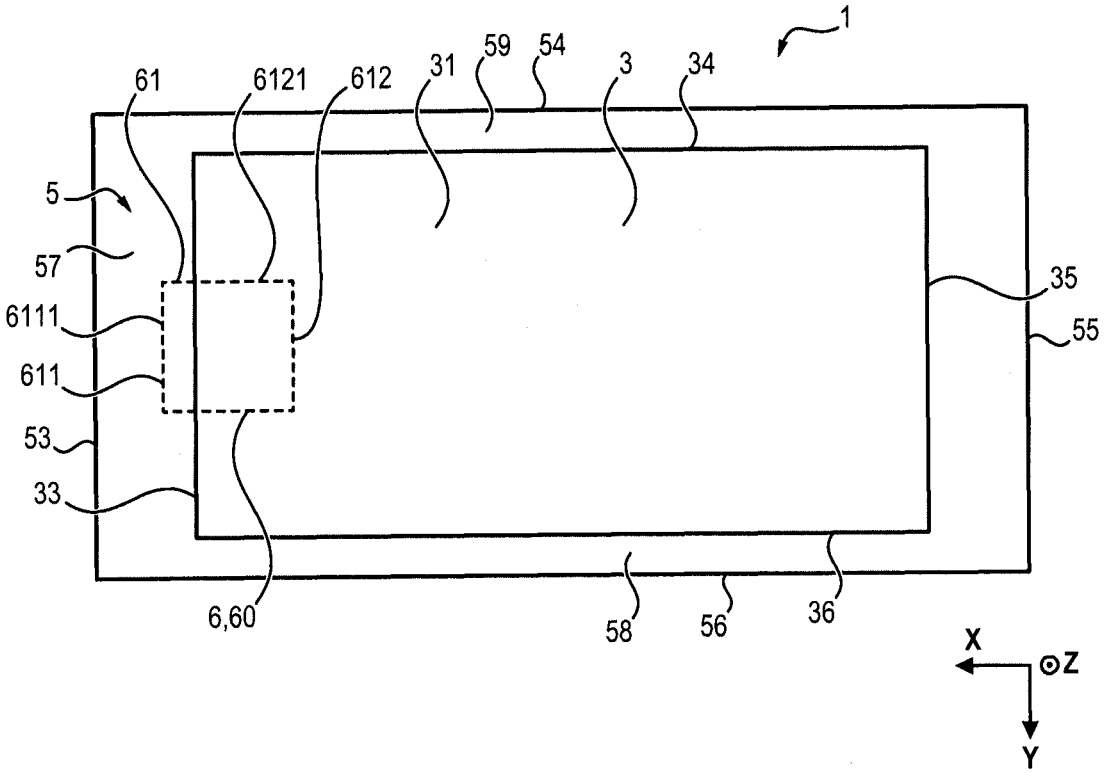
FIG. 2 is a schematic upper view of a portable wireless phone device according to the first embodiment of the invention.
Figure 3:
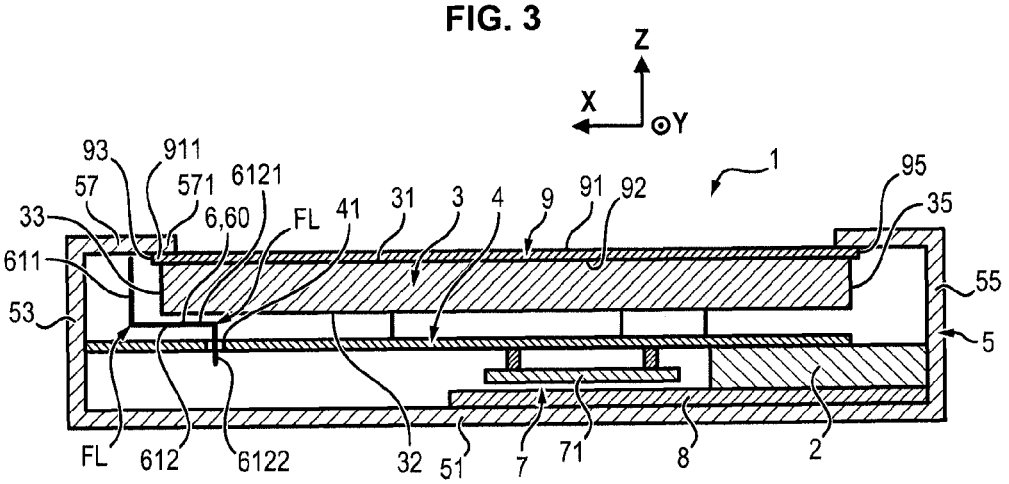
FIG. 3 is a schematic cross section side view of a portable wireless phone device according to a second embodiment of the invention.
Figure 4:
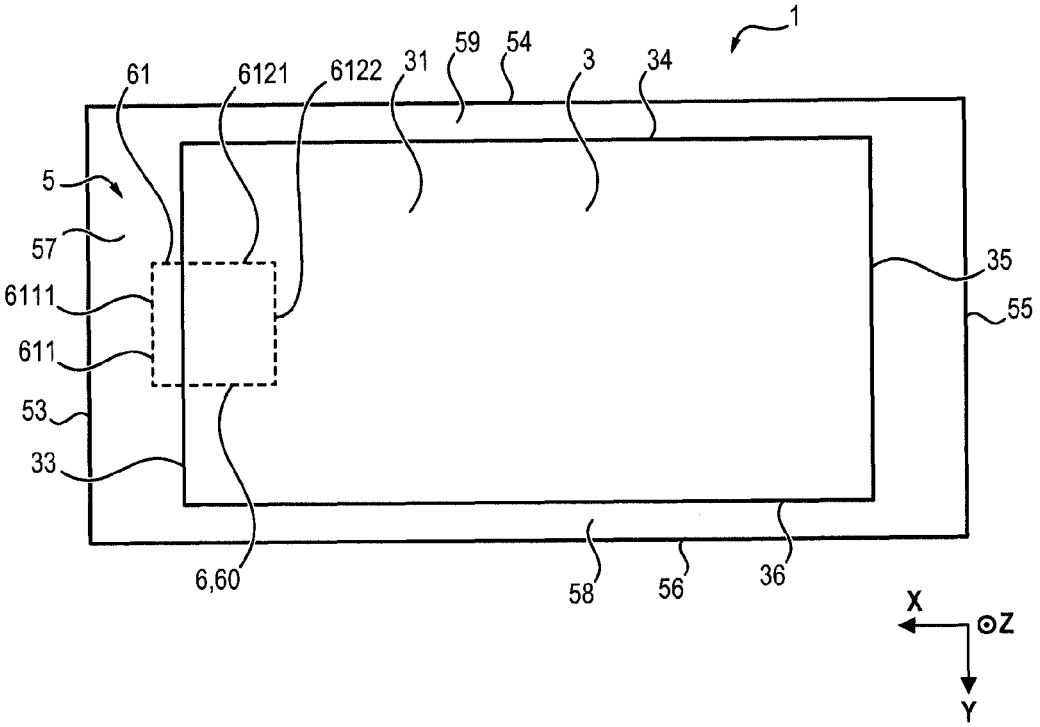
FIG. 4 is a schematic upper view of a portable wireless phone device according to the second embodiment of the invention.
Figure 5:
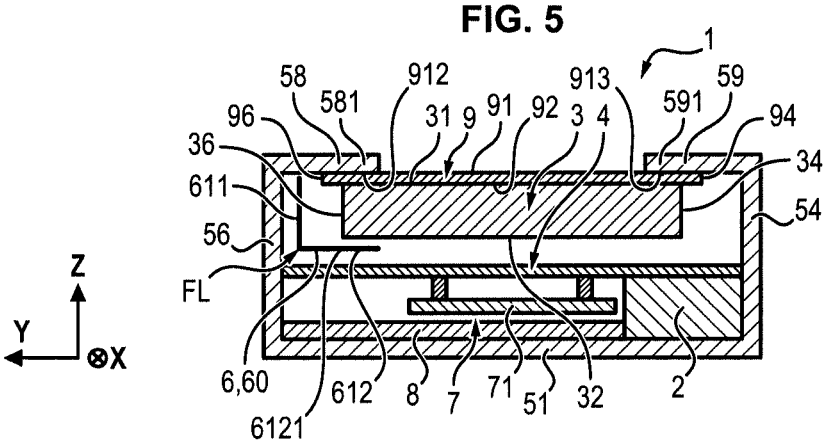
FIG. 5 is a schematic cross section side view of a portable wireless phone device according to a third embodiment of the invention.
Figure 6:
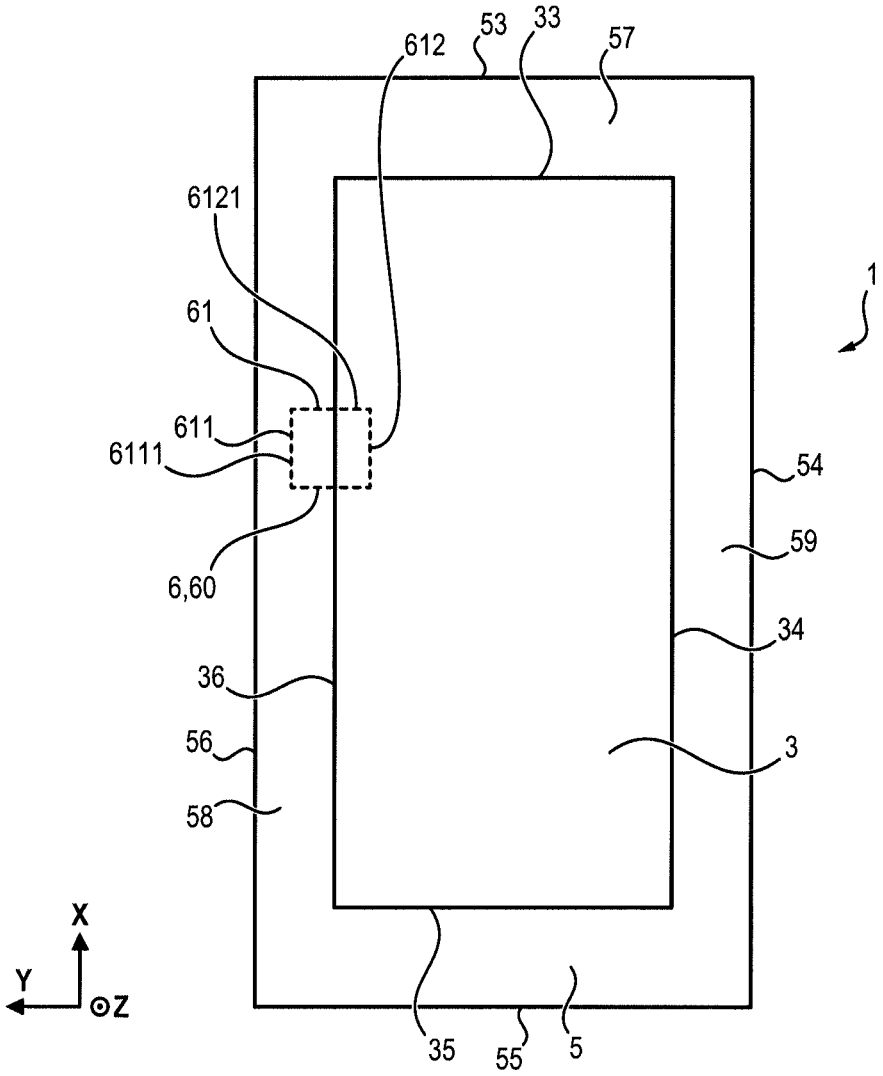
FIG. 6 is a schematic upper view of a portable wireless phone device according to the third embodiment of the invention.
Figure 7:
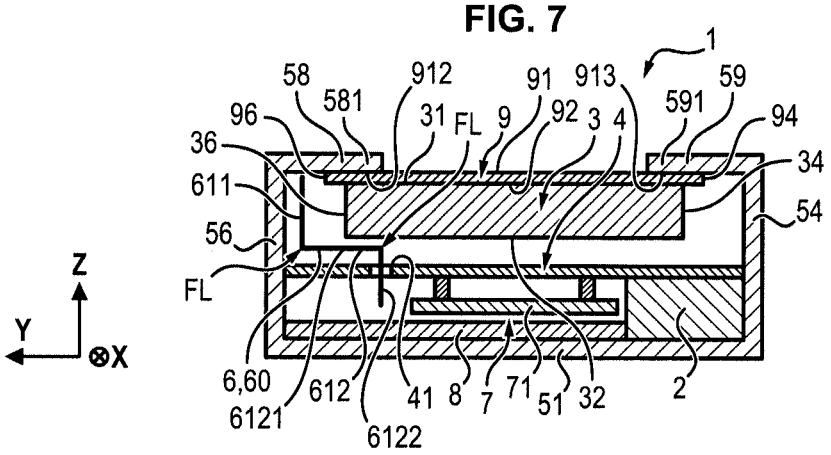
FIG. 7 is a schematic cross section side view of a portable wireless phone device according to a fourth embodiment of the invention.
Figure 8:
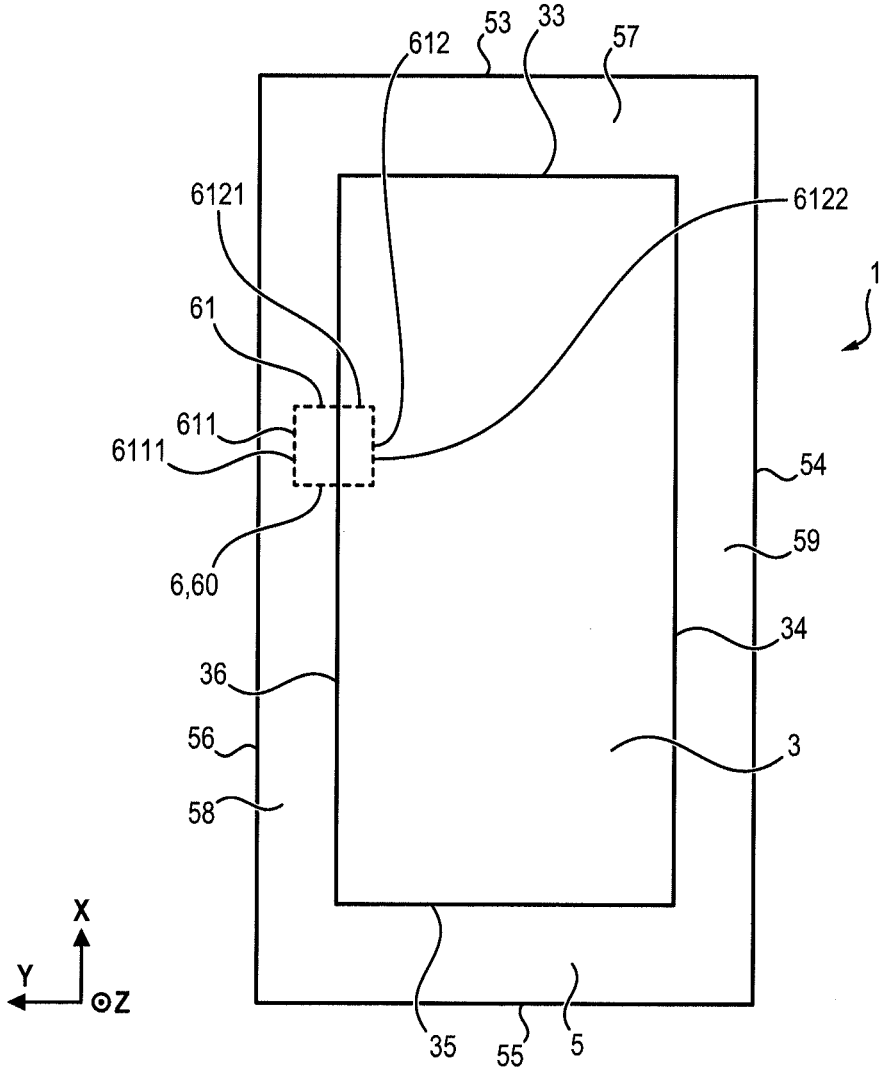
FIG. 8 is a schematic upper view of a portable wireless phone device according to the fourth embodiment of the invention.

In the following, NFC means Near Field Communication. RFID means radio frequency identification.

In the FIGS. 1 to 14, a portable wireless phone device 1 comprises a first antenna 2 for phone communication and an upper display module 3. Device 1 is a wireless telephone and can be for example a cell phone, a mobile telephone, a GSM phone, a personal digital assistant PDA, a smartphone, a touchscreen tablet. The first antenna 2 serves to voice communication and/or data communication (images, e-mails, messages like for examples SMS messages (SMS means Short Message Service), MMS messages (MMS means Multimedia Messaging Service), Internet communications or others) with a remote wireless network, distinct from device 1.

The upper display module 3 has a first upper face 31, a first lower face 32 and first side faces 33, 34, 35, 36 connecting the first upper face 31 to the first lower face 32. An upper transparent wall 9 is provided on the first upper face 31 of the upper display module 3. The upper transparent wall 9 may be made of glass or plastics. The wall 9 may extend beyond the first upper face 31. The wall 9 serves to protect the first upper face 31 and the upper display module 3. The upper wall 9 is in contact with outside of device 1. Of course, in other embodiments, the wall 9 may stop at the first upper face 31 and have the same size as the first upper face 31.

Module 3 serves to display images on the upper face 31 to the outside through the upper transparent wall 9 Recently, in a lot of devices 1, the area covered by the upper display module 3 has become higher and higher, to show always bigger images to the user. Also, the module 3 has metallic surfaces. For example, the first lower face 32 of the upper display module 3 is a metallic surface.

The device 1 contains also other metallic surfaces.

An inner metallic board 4 is situated between the first lower face 32 and a second lower face 51 of an external housing assembly 5.

The external housing assembly 5 has second side faces 53, 54, 55, 56 connected to the second lower face 51. Each first side face 33, 34, 35, 36 faces one of the second side faces 53, 54, 55, 56 respectively. The external housing assembly 5 forms with the upper transparent wall 9 a closed housing. In an embodiment, the external housing assembly 5 can be formed by a shell closed by a lid, which may have an opening position to give an access to the interior of the shell and a closed position not to give access to the interior of the shell, wherein the lid can be moved between the two positions.

The upper transparent wall 9 has a third upper face 91, a third lower face 92, and third side faces 93, 94, 95, 96. The third side faces 93, 94, 95, 96 connect the third upper face 91 to the third lower face 92. Each third side face 93, 94, 95, 96 faces one of the second side faces 53, 54, 55, 56 respectively. The third upper face 91 is in contact with the outside of the device 1. The third lower face 92 is against the first upper face 31.

For example, in the figures, X is first longitudinal direction, Y is a second transversal direction and Z is a vertical direction. For example, X is a longitudinal and horizontal direction, Y is a transversal and horizontal direction and Z is a vertical direction.

For example, sides faces 34, 54, 36, 56 may be longitudinal (they extend along longitudinal direction X), side faces 33, 53, 35, 55 may be transversal (they extend along transversal direction Y) and faces 31, 32, 51, 57 may be horizontal.

For example, the face 33 may be adjacent (is connected to) to face 34, face 34 may be adjacent (is connected to) to face 35, face 35 may be adjacent (is connected to) to face 36 and face 36 may be adjacent (is connected to) to face 33. For example, the faces 33, 34, 35, 36 may form a rectangle.

For example, the face 53 may be adjacent (is connected to) to face 54, face 54 may be adjacent (is connected to) to face 55, face 55 may be adjacent (is connected to) to face 56 and face 56 may be adjacent (is connected to) to face 53. For example, the faces 53, 54, 55, 56 may form a rectangle.

For example, the face 93 may be adjacent (is connected to) to face 94, face 94 may be adjacent (is connected to) to face 95, face 95 may be adjacent (is connected to) to face 96 and face 96 may be adjacent (is connected to) to face 93. For example, the faces 93, 94, 95, 96 may form a rectangle.

For example, X is orthogonal to Y. For example, Z is orthogonal to direction X and to direction Z.

The external housing assembly 5 encloses the inner metallic board 4, the first antenna 2, a second NFC antenna 6 and an electrical circuit 7. The electrical circuit 7 serves to control the upper display module 3, the first antenna 2 and the second NFC antenna 6. The inner metallic board 4 serves to support the electrical circuit 7, which can comprise for example one or several printed circuit board(s) 71. The inner metallic board 4 is also provided for electromagnetic compatibility. The inner metallic board 4 is at a distance from the first lower face 32. The inner metallic board 4 may be a metal plate. The device 1 comprises also a battery 8 for feeding electrical power to all the electrical parts of the device 1, including the electrical circuit 7, the upper display module 3, the first antenna 2 and the second NFC antenna. The battery 8 can be loaded via an electrical port of the external housing assembly 5, to be loaded from the outside. The battery 8 feeds DC current.

The second NFC antenna 6 comprises a NFC loop antenna 60 having at least one turn 61. The second NFC antenna 6 is a RFID antenna. The NFC loop antenna 60 is a RFID antenna. Of course, one or several second NFC antennas 6 may be provided.

In the embodiments of the device 1, the NFC antenna 6 can be used as reader and/or transponder. In the embodiments of the device 1, the NFC loop antenna 60 can be used as reader and/or transponder.

In an embodiment, the NFC antenna 6 and/or the NFC loop antenna 60 are incorporated in an electrically isolating sheet or electrically isolating substrate, which is for example flexible.

The NFC loop antenna 60 is magnetic, i.e. mainly radiates a magnetic field.

Figure 16:
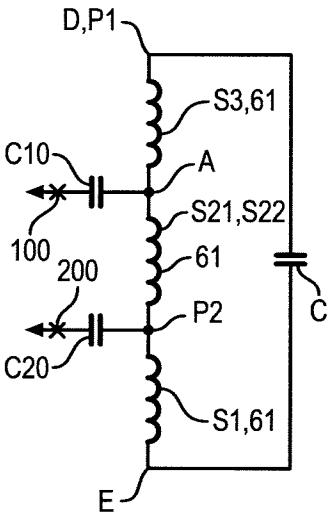
Figure 15:
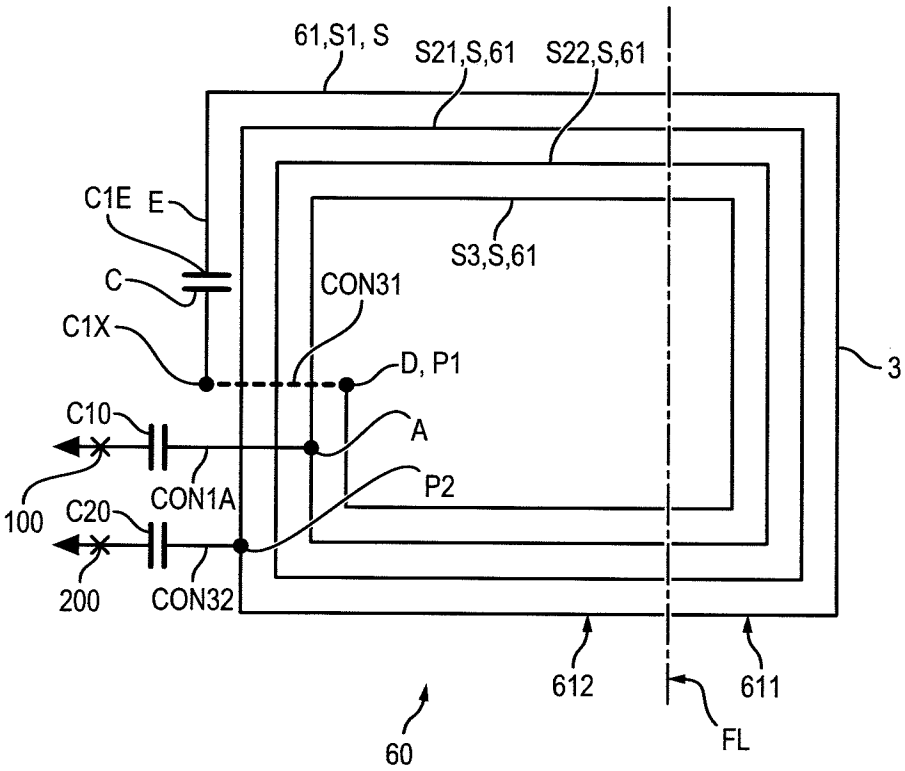
FIG. 15 is a schematic upper view of an embodiment of an NFC antenna, which can be used in the portable wireless phone device according to the invention, FIG. 16 show an equivalent electric layout of the antenna of FIG. 15.

The NFC loop antenna 60 may have several turns 61, for example as provided in FIGS. 15 and 16. In case of several turns 61 and on FIGS. 15 and 16, the turns 61 are concentric, i.e. the NFC loop antenna 60 is flat, i.e. the NFC loop antenna 60 is bi-dimensional or plane. In this case, the turns 61 extend around a same center. FIG. 15 shows the turns 61, also called S, extending in the plane of the figure. In case of several turns 61 and on FIGS. 15 and 16, the turns 61 may extend in the same plane. In case that the electrically isolating sheet or electrically isolating substrate, on which is the NFC loop antenna 60, is flexible, the electrically isolating sheet or electrically isolating substrate may be folded. Then, in the device 1, the NFC loop antenna 60 may extend in one or several planes. The turns 61 have parts (for example segments) close to each other (same angular zone around the center) which extend in the same plane. For example, in FIG. 15, the NFC loop antenna 60 may be folded across folding line FL crossing the turns. When the NFC loop antenna 60 is folded across folding line F, the turns 61 or S extend in two secant planes, for example in a first plane in which first part 611 is situated, and in a second plane in which second part 612 is situated. Of course, the NFC loop antenna 60 may be folded across several folding line FL crossing the turns. The at least one folding line FL may be rectilinear. Then, in device 1, the at least one turn 61 extends in one plane or in one folded plane. Then, in device 1, the NFC loop antenna 60 extends in one plane or in one folded plane. In the embodiments shown on FIGS. 1, 2, 3, 4, 5, 6, 7, 8, 9, 10, 11 and 12, the at least one turn 61 comprises:

- at least one first part 611 situated at a distance from the inner metallic board 4 and between at least one determined of the first side faces 33, 34, 35, 36 and at least one determined of the second side faces 53, 54, 55, 56, facing each other,
- at least one second part 612 situated under the first lower face 32.

Surprisingly, this improves the radiation of magnetic field of the NFC antenna 6 towards the second upper face 57 and/or 58 and/or 59 of the external housing assembly 5, even in view of NFC antennas which would be entirely situated at a side of the upper display module 3.

In the embodiments of FIGS. 1, 2, 3, 4, the first part 611 of the at least one turn 61 is situated between the first side face 33 and the second side face 53 facing the first side face 33.

In the embodiments of FIGS. 1, 2, 5, 6, 9, 10, 11, 12, the second part 612 of the at least one turn 61 is situated between the first lower face 32 and the inner metallic board 4.

In the embodiments of FIGS. 1, 2, 5, 6, 9, 10, 11, 12, the second part 612 of the at least one turn 6 comprises a first subpart 6121 situated between the first lower face 32 and the inner metallic board 4.

In the embodiments of FIGS. 3, 4, 7, 8, the second part 612 of the at least one turn 6 comprises a first subpart 6121 situated between the first lower face 32 and the inner metallic board 4 and a second subpart 6122 situated between the inner metallic board 4 and the second lower face 51.

This improves the radiation of magnetic field of the NFC antenna 6 both towards the second upper face 57 and/or 58 and/or 59 of the external housing assembly 5 and towards the lower side 51.

In the embodiments of FIGS. 3, 4, 7, 8, the inner metallic board 4 comprises at least one hole 41, wherein the second part 612 gets through the hole 41.

In the embodiments shown on the FIGS. 1 to 12, the first part 611 comprises at least one rectilinear segment 6111. In the embodiment shown on the FIGS. 11, 12, the other first part 611*b* comprises also at least one other rectilinear segment 6111*b*.

In the embodiments shown on FIGS. 1, 2, 3, 4, 13, 14, the first part 611 extends under a second upper face 57 of the external housing assembly 5. The second upper face 57 faces the second lower face 51.

In the embodiments shown, the second upper face 57 of the external housing assembly 5 has a portion 571 extending on an end 911 of the third upper face 91 of the upper transparent wall 9.

In some embodiments, the first part of the at least one turn is situated between at least one determined of the third side faces of the upper transparent wall and at least one determined of the second side face.

In the embodiments of FIGS. 1, 2, 3, 4, 13, 14, the first part 611 of the at least one turn 61 is situated between the third side face 93 of the upper transparent wall 9 and the second side face 53, facing each other.

In the embodiments shown on FIGS. 5, 6, 7, 8, the first part 611 of the at least one turn 61 is situated between the first side face 36 and the second side face 56 facing the first side face 36.

In the embodiments shown on FIGS. 5, 6, 7, 8, the first part 611 extends under a second upper face 58 of the external housing assembly 5. The second upper face 58 faces the second lower face 51.

In the embodiments shown, the second upper face 58 of the external housing assembly 5 has a portion 581 extending on an end 912 of the third upper face 91 of the upper transparent wall 9.

In the embodiments of FIGS. 5, 6, 7, 8, the first part 611 of the at least one turn 61 is situated between the third side face 96 of the upper transparent wall 9 and the second side face 56, facing each other.

Figure 9:
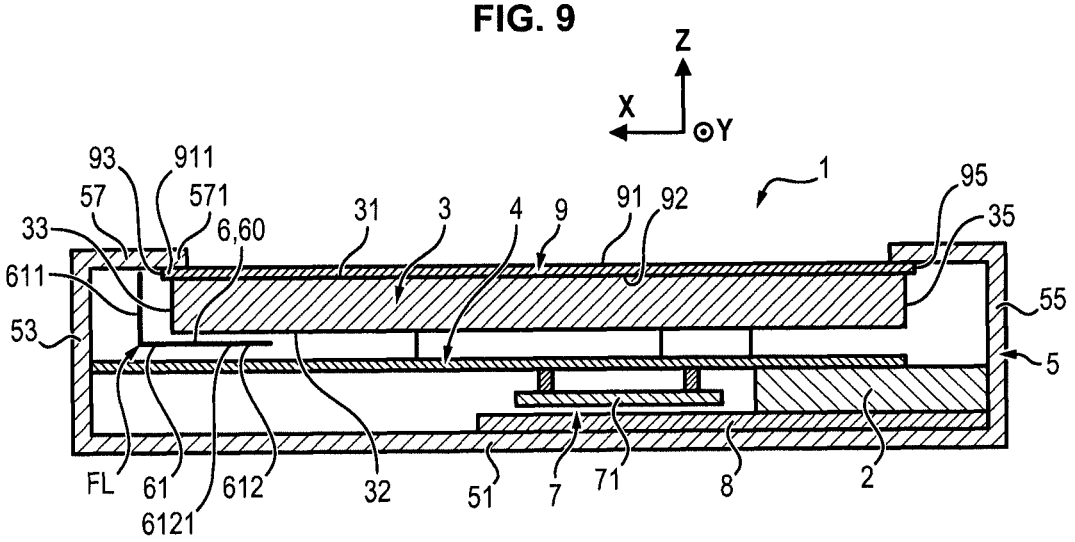
FIG. 9 is a schematic cross section side view of a portable wireless phone device according to a fifth embodiment of the invention.
Figure 10:
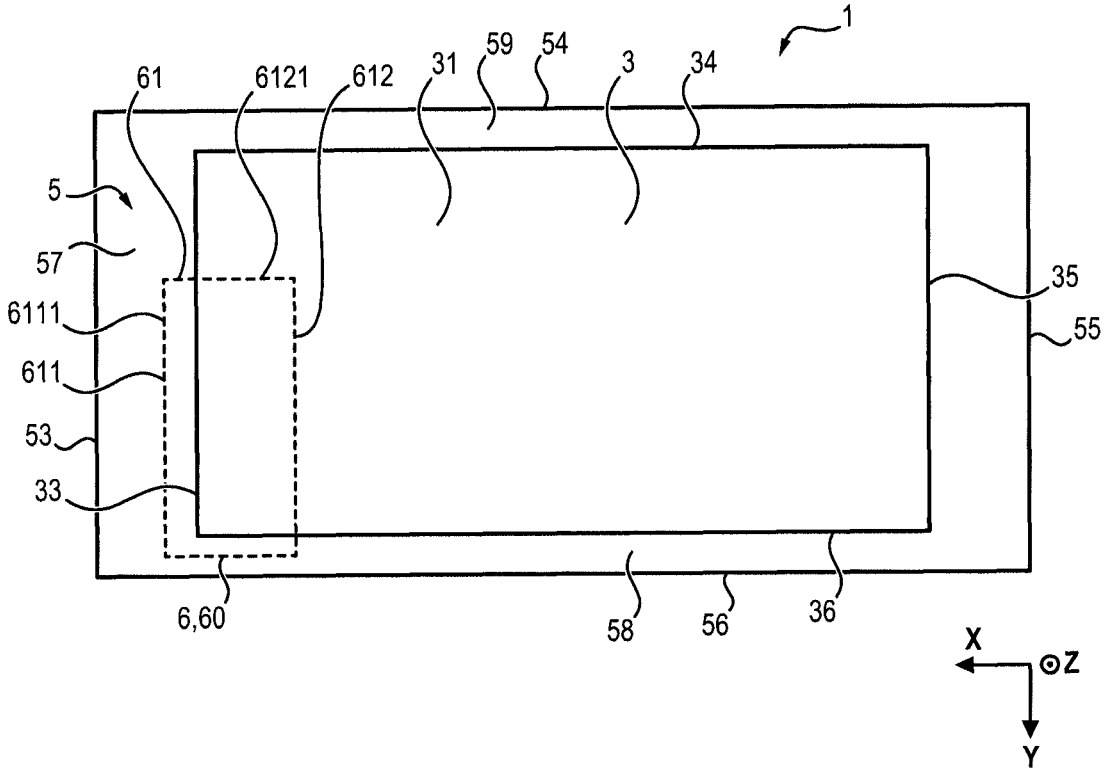
FIG. 10 is a schematic upper view of a portable wireless phone device according to the fifth embodiment of the invention.

In the embodiment shown on FIGS. 9, 10, the first part 611 of the at least one turn 61 is situated between the first side face 33 and the second side face 53 facing the first side face 33 and between the first side face 36 and the second side face 56 facing the first side face 36.

In the embodiment shown on FIGS. 9, 10, the first part 611 extends under the second upper face 57 of the external housing assembly 5 and under the second upper face 58 of the external housing assembly 5.

In the embodiment of FIGS. 9, 10, the first part 611 of the at least one turn 61 is situated between the third side face 96 of the upper transparent wall 9 and the second side face 56, facing each other, and between the third side face 93 of the upper transparent wall 9 and the second side face 53, facing each other.

Figure 11:
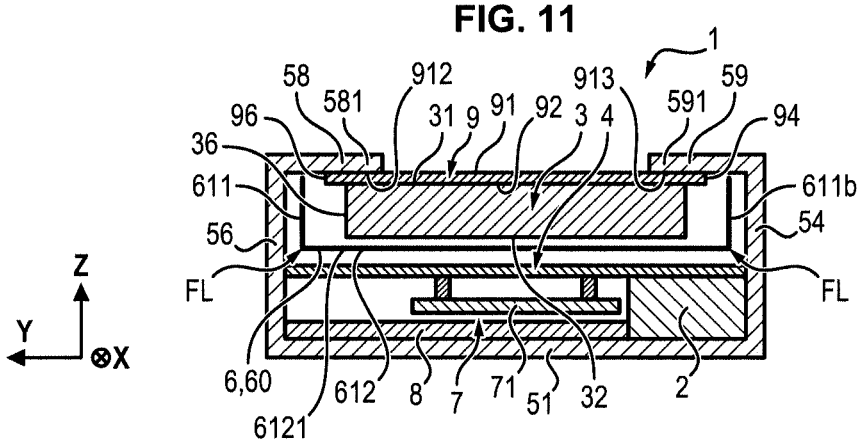
FIG. 11 is a schematic cross section side view of a portable wireless phone device according to a sixth embodiment of the invention.
Figure 12:
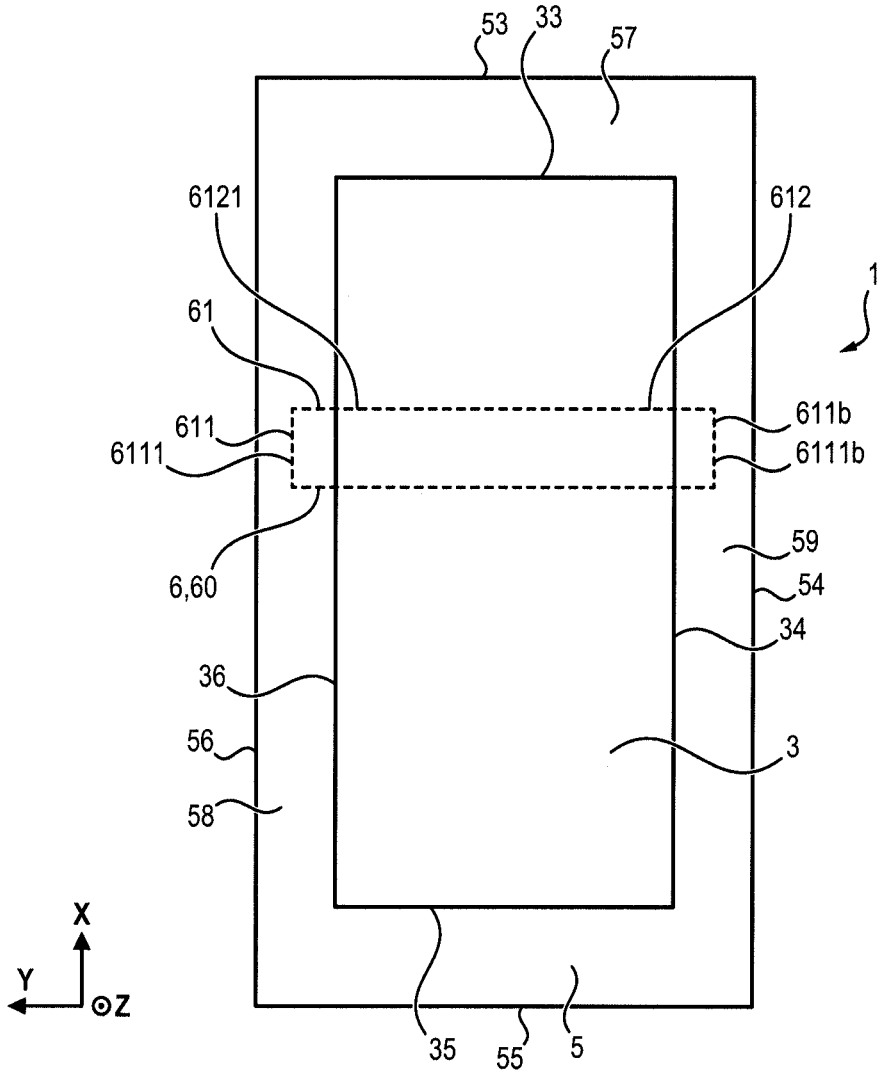
FIG. 12 is a schematic upper view of a portable wireless phone device according to the sixth embodiment of the invention.

In the embodiment shown on FIGS. 11, 12, there is the first part 611 of the at least one turn 61 which is situated between the first side face 36 and the second side face 56 facing the first side face 36 and another first part 611*b* of the at least one turn 61 which is situated between the first side face 34 and the second side face 54 facing the first side face 34.

In the embodiment shown on FIGS. 11, 12, the first part 611 extends under the second upper face 58 of the external housing assembly 5 and the other first part 611*b* extends under the second upper face 59 of the external housing assembly 5. The second upper face 59 faces the second lower face 51.

In the embodiments shown, the second upper face 59 of the external housing assembly 5 has a portion 591 extending on an end 913 of the third upper face 91 of the upper transparent wall 9.

The second upper face 57 and/or 58 and/or 59 may extend along X at the same length as face 35, or may extend along X beyond face 35, or may extend along X before face 35.

In the embodiment shown on FIGS. 11, 12, the first part 611 of the at least one turn 61 is situated between the third side face 96 of the upper transparent wall 9 and the second side face 56, facing each other, and between the third side face 94 of the upper transparent wall 9 and the second side face 54, facing each other.

Figure 13:
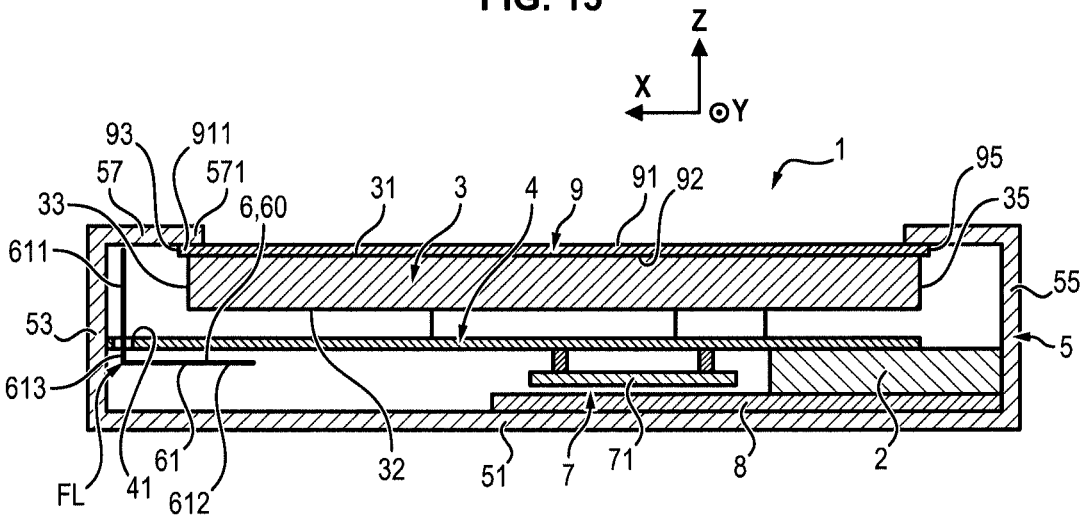
FIG. 13 is a schematic cross section side view of a portable wireless phone device according to a seventh embodiment of the invention.
Figure 14:
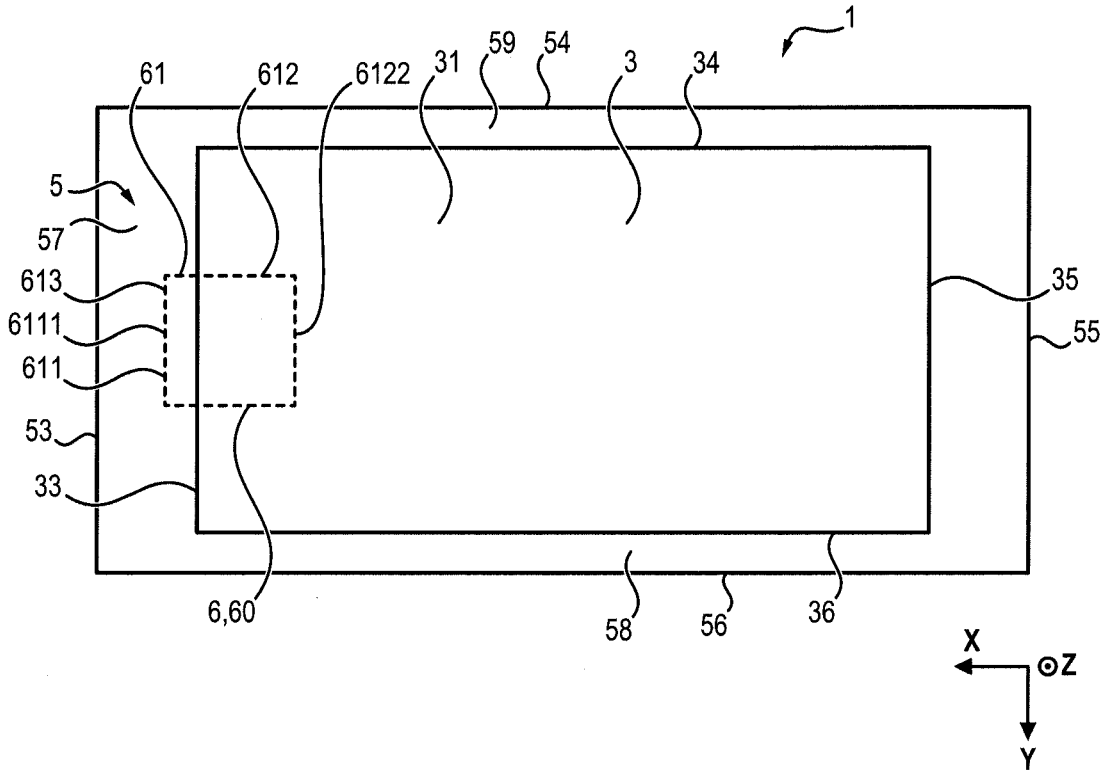
FIG. 14 is a schematic upper view of a portable wireless phone device according to the seventh embodiment of the invention.

In the embodiment shown on FIGS. 13 and 14, the second part 612 is entirely situated between the inner metallic board 4 and the second lower face 51 of the external housing assembly 5.

In the embodiment of FIGS. 13 and 14, the inner metallic board 4 comprises at least one hole 41. The at least one turn 61 comprises at least one third part 613 connecting the first part 611 to the second part 612. The third part 613 gets through the hole 41. In the embodiment shown on FIGS. 13 and 14, the second part 612 situated between the inner metallic board 4 and the second lower face 51 comprises at least one rectilinear segment 6122.

The second part 612 or the entire turn 61 entirely situated between the inner metallic board 4 and the second lower face 51 improves the radiation of magnetic field of the NFC antenna 6 towards the lower side 51.

FIGS. 15 and 16 show an embodiment of an NFC antenna 6 which can be used in the device 1.

In an embodiment, as an example, on FIGS. 15 and 16, the NFC antenna 6 comprises:

the NFC loop antenna 60 formed by a number of at least three turns (S, 61, S1, S21, S22, S3), the antenna 60 having a first end terminal (D) and a second end terminal (E), at least two access terminals (100, 200) to connect a charge, at least one tuning capacitance (C) for tuning at a prescribed tuning frequency, having a first capacitance terminal (C1X) and a second capacitance terminal (C1E), an intermediate tap (A) connected to the antenna 60 and distinct from the first end terminal (D) and from the second end terminal (E), first connection means (CON1A) connecting the intermediate tap (A) to a first (100) of the two access terminals, second connection means (CON2E) connecting the second end terminal (E) to the second capacitance terminal (C1E), third connection means (CON31, CON32) connecting the first capacitance terminal (C1X) and the second (200) of the access terminals respectively to a first point (P1) of the antenna 60 and to a second point (P2) of the antenna 60, wherein the second point (P2) is connected to the second end terminal (E) of the antenna by at least one turn (S, S1, 61) of the antenna (L) and is connected to the first point (P1) of the antenna (L) by at least one turn (S, S21, S22, S23) of the antenna 60.

In an embodiment, there is at least one turn S21, S23, 61 between the intermediate tap (A) and the second point (P2).

In an embodiment, there is at least one turn S3, 61 between the intermediate tap (A) and the first point (P1).

The access terminals 100 and 200 are connected to the electrical circuit 7.

In the above, the faces may be plane or contain a plane part.

Of course, the faces may be other than the one shown on the figures.

In other embodiments, the faces may be curved or contain a curved portion.

The invention claimed is:

1. A portable wireless phone device, comprising a first antenna for phone communication, an upper display module having a first upper face, a first lower face and first side faces connecting the first upper face to the first lower face, an inner metallic board situated between the first lower face and a second lower face of an external housing assembly having second side faces connected to the second lower face, each first side face facing one of the second side faces, the external housing assembly enclosing the inner metallic board, the first antenna, a second NFC antenna and an electrical circuit for controlling the upper display module, the first antenna and the second NFC antenna, wherein the second NFC antenna comprises a NFC loop antenna having at least one turn, wherein the at least one turn comprises at least one first part situated at a distance from the inner metallic board and between at least one determined of the first side faces and at least one determined of the second side faces, facing each other, at least one second part situated under the first lower face.

2. The portable wireless phone device of claim 1, wherein the second part is situated between the first lower face and the inner metallic board.

3. The portable wireless phone device of claim 1, wherein the second part comprises a first subpart situated between the first lower face and the inner metallic board.

4. The portable wireless phone device of claim 3, wherein the second part comprises a second subpart situated between the inner metallic board and the second lower face.

5. The portable wireless phone device of claim 4, wherein the inner metallic board comprises at least one hole, wherein the second part gets through the hole.

6. The portable wireless phone device of claim 1, wherein the first part comprises at least one rectilinear segment.

7. The portable wireless phone device of claim 6, wherein the first part extends under a second upper face of the external housing assembly facing the second lower face.

8. The portable wireless phone device of claim 1, wherein an upper transparent wall is provided on the first upper face of the upper display module, the upper transparent wall has a third upper face, a third lower face and third side faces connecting the third upper face to the third lower face, each third side face facing one of the second side faces, the third lower face is against the first upper face, the first part of the at least one turn is situated between at least one determined of the third side faces of the upper transparent wall and at least one determined of the second side face.

9. The portable wireless phone device of claim 1, wherein the second part is entirely situated between the inner metallic board and the second lower face of the external housing assembly, the inner metallic board comprises at least one hole, the at least one turn comprises at least one third part connecting the first part to the second part, the third part gets through the hole.

10. The portable wireless phone device of claim 9, wherein the second part comprises at least one rectilinear segment.

* * * * *